428-570 SR
8/19/86 XR 4,606,948

United States Patent [19]
Hajmrle et al.

[11] Patent Number: 4,606,948
[45] Date of Patent: Aug. 19, 1986

[54] PROCESS FOR THE PRODUCTION OF NICKEL-CHROMIUM/CHROMIUM CARBIDE COATINGS ON SUBSTRATES

[75] Inventors: Karel Hajmrle, Fort Saskatchewan; Vilnis Silins, Edmonton, both of Canada

[73] Assignee: Sherritt Gordon Mines Limited, Toronto, Canada

[21] Appl. No.: 736,046

[22] Filed: May 20, 1985

[30] Foreign Application Priority Data

Jun. 4, 1984 [GB] United Kingdom ..... 8414219

[51] Int. Cl.[4] ..... B05D 1/10
[52] U.S. Cl. ..... 427/423; 428/570
[58] Field of Search ..... 428/570; 427/423

[56] References Cited

U.S. PATENT DOCUMENTS 3,150,938 9/1964 Pelton ..... 427/423 X
3,914,507 10/1975 Fustukian ..... 428/570

FOREIGN PATENT DOCUMENTS

WO83/01917 6/1983 PCT Int'l Appl. ..... 428/570

*Primary Examiner*—Shrive P. Beck
*Attorney, Agent, or Firm*—Robert F. Delbridge; Arne I. Fors

[57] ABSTRACT

A process for producing a nickel-chromium/chromium carbide coating on a substrate comprises flame spraying nickel/chromium carbide composite powder onto the substrate to cause burnout of some of the carbon in the carbide during spraying with the result that some of the chromium becomes alloyed with the nickel. The nickel/chromium carbide composite powder comprises particles each having a core of chromium carbide at least partially coated with nickel, and the coating comprises chromium carbide particles in a matrix of nickel-chromium alloy.

14 Claims, No Drawings

PROCESS FOR THE PRODUCTION OF NICKEL-CHROMIUM/CHROMIUM CARBIDE COATINGS ON SUBSTRATES

This invention relates to the production of nickel-chromium/chromium carbide coatings on substrates.

It is well known to deposit hard coatings by spraying onto a substrate to provide the substrate with a hard and durable facing. A nickel-chromium/chromium carbide coating is a preferred coating for some applications, that is to say a coating comprising chromium carbide particles in a matrix of nickel-chromium alloy. The usual procedure is to plasma spray a mixture of nickel chromium alloy powder and chromium carbide powder. A preferred method is to spray a nickel-chromium/-chromium carbide composite powder onto the substrate, namely a powder whose particles each comprise a core of chromium carbide at least partially coated with nickel-chromium. Such a powder is produced by chromizing a nickel/chromium carbide composite powder in a chromizing operation such as described in U.S. Pat. No. 3,914,507 (Fustukian) issued Oct. 21, 1975. However, such a chromizing operation adds unwanted expense to the operation.

It has now been discovered that a satisfactory nickel-chromium/chromium carbide coating can be deposited on a substrate by flame spraying nickel/chromium carbide composite powder onto the substrate to cause burnout of some of the carbon in the carbide during spraying with the result that some of the chromium becomes alloyed with the nickel Not only does such a process in accordance with the invention enable the prior chromizing step to be omitted, with consequent cost saving, but also utilizes flame spraying which is a less expensive spraying procedure compared to other forms of spraying, such as plasma spraying. Further, the carbon burnout during spraying results in additional heat being generated, and such heat is beneficial to the spraying operation.

Carbon burnout and matrix alloying has previously been observed during the detonation deposition of mixtures of cobalt and tungsten carbide onto substrates, see R. A. Alphintseve et al "Structural Investigations on the D-Gun Co-WC Coatings". Poroshkovaya Metallurgia, No. 10, 1982, page 24. However, it would not have been expected from such prior art that a similar effect could be utilized in flame spraying nickel/-chromium carbide composite powder as in the present invention since tungsten carbide is very soluble in the cobalt matrix, whereas chromium carbide is much less soluble in the nickel matrix. However, the simultaneous carbon burnout permits much higher alloying levels of chromium in nickel than could be expected from the equilibrium data for chromium carbide dissolution in nickel. Only levels much higher than the equilibrium value are of importance in practical applications, i.e. more than 12% and possibly 20% chromium in nickel is desirable.

The nickel/chromium carbide composite powder to be flame sprayed may comprise particles whose chromium carbide cores are of a size in the range of from about 1 to about 100 μm, preferably from about 5 to about 25 μm. The nickel content of each particle may be in the range of from about 1 to about 80% by weight, preferably from about 15 to about 45%. Besides nickel, other elements such as cobalt and/or molybdenum may be present in the cladding of each composite powder particle. The actual chromium carbide composition of the core may comprise any suitable chromium carbide, such as $Cr_3C_2$, $Cr_{23}C_6$, $Cr_7C_3$ or mixtures thereof. Also, other elements such as molybdenum may be present in the chromium carbide cores.

The nickel-chromium matrix of the substrate coating may contain from at least 1 to about 50% chromium by weight, the optimum chromium content depending on the intended purpose of the coating as will be readily apparent to a person skilled in the art.

A specific example of the invention will now be described:

$Ni/Cr_3C_2$ powder contained (by weight) 41.0% nickel, 50.76% chromium, 8% carbon and 0.24% oxygen. The average chromium carbide particle size was 18 μm.

The flame spraying was carried out with a Metco 6P gun with a 7A-D nozzle, and powder feed was effected by a Metco feeder 3MP with a single 'S' powder feed wheel at 28 g/min. The combustion gas was controlled by 2 GF flow meters and consisted of 30% flow of oxygen at 15 psig, and 55% flow of acetylene at 15 psig. The powder carrier gas was nitrogen at a flow of 37% on the 3MP feed unit flow meter. Cooling air was fed through a 6P-3 nozzle at 45 psig. The spray distance was 3.9 inches, horizontal traverse being quickly by hand, and vertical traverse being 0.125 in/pass. The chemical composition of the coating was 41.55% Ni, 51.42% Cr, 6.7% C, and 0.33% O.

Evidence that the sprayed coating consists of a nickel-chromium alloy is given by the fact that it was non-magnetic and therefore must contain at least 7% chromium in solid solution, and by the good corrosion resistance, as follows. After 118 hours in a mixture of 125 mL 70% nitric acid and 125 mL water at room temperature, no attack on the coating was observed. This behaviour was as good as that of prealloyed 80 Ni/20 Cr powder or prealloyed 45 $NiCr/Cr_3C_2$55 composite powder. However, in the same test 41 $Ni/Cr_3C_2$59 powder dissolved rapidly in several minutes.

Other embodiments and examples of the invention will be readily apparent to a person skilled in the art.

What we claim as new and desire to protect by Letters Patent of the United States is:

1. A process for producing a nickel-chromium/-chromium carbide coating on a substrate comprising providing nickel/chromium carbide composite powder comprising particles each having a core of chromium carbide at least partially coated with nickel without chromium being present in the nickel coating, and flame spraying said nickel/chromium carbide composite powder onto the substrate to cause burn-out of some of the carbon in the chromium carbide during spraying with the result that some of the chromium of the chromium carbide becomes alloyed with the nickel to produce a sprayed coating on the substrate comprising chromium carbide particles in a matrix of nickel-chromium alloy.

2. A process according to claim 1 wherein the nickel/chromium carbide composite powder comprises particles whose chromium carbide cores are of a size in the range of from about 1 to about 100 μm.

3. A process according to claim 2 wherein the nickel/chromium carbide composite powder comprises particles whose chromium carbide cores are of a size in the range of from about 5 to about 25 μm.

4. A process according to claim 1 wherein the nickel content of each particle is in the range of from about 1 to about 80% by weight.

5. A process according to claim 4 wherein the nickel content of each particle is in the range of from about 15 to about 45% by weight.

6. A process according to claim 1 wherein the nickel/chromium carbide composite powder comprises particles whose nickel content of each particle is in the range of from about 1 to about 80% by weight and whose chromium carbide cores are of a size in the range of from about 1 to about 100 μm.

7. A process according to claim 1 wherein the nickel/chromium carbide composite powder comprises particles whose nickel content of each particle is in the range of from about 15 to about 45% by weight and whose chromium carbide cores are of a size in the range of from about 5 to about 25 μm.

8. A process according to claim 1 wherein the nickel/chromium carbide composite powder comprises particles each having a core of chromium carbide at least partially coated with nickel and at least one of the elements cobalt and molybdenum.

9. A process according to claim 8 wherein the nickel/chromium carbide composite powder comprises particles each having a core of chromium carbide at least partially coated with nickel and cobalt.

10. A process according to claim 8 wherein the nickel/chromium carbide composite powder comprises particles each having a core of chromium carbide at least partially coated with nickel and molybdenum.

11. A process according to claim 8 wherein the nickel/chromium carbide composite powder comprises particles each having a corre of chromium carbide at least partially coated with nickel, cobalt and molybdenum.

12. A process according to claim 1 wherein the chromium carbide cores of the composite powder particles comprises a chromium carbide selected from the group consisting of $Cr_3C_2$, $Cr_{23}C_6$, $Cr_7C_3$ and mixtures thereof.

13. A process according to claim 1 wherein the chromium carbide cores of the composite powder particles also contain molybdenum.

14. A process according to claim 1 wherein the nickel-chromium matrix of the sprayed coating on the substrate contains from about 1 to about 50% chromium by weight.

* * * * *